US010161708B1

(12) United States Patent
Ady

(10) Patent No.: US 10,161,708 B1
(45) Date of Patent: Dec. 25, 2018

(54) BOWSTRING CONSTRICTOR

(71) Applicant: Daniel Dean Ady, Caldwell, ID (US)

(72) Inventor: Daniel Dean Ady, Caldwell, ID (US)

( * ) Notice: Subject to any disclaimer, the term of this patent is extended or adjusted under 35 U.S.C. 154(b) by 0 days.

(21) Appl. No.: 15/881,769

(22) Filed: Jan. 27, 2018

Related U.S. Application Data

(60) Provisional application No. 62/451,496, filed on Jan. 27, 2017.

(51) Int. Cl.
*F41B 5/00* (2006.01)
*F41G 1/467* (2006.01)
*F41B 5/14* (2006.01)

(52) U.S. Cl.
CPC ..... *F41B 5/1419* (2013.01); *F41B 5/1411* (2013.01)

(58) Field of Classification Search
CPC ..... F41B 5/1411; F41B 5/1419
See application file for complete search history.

(56) References Cited

U.S. PATENT DOCUMENTS 4,934,332 A * 6/1990 Scherz ..... F41G 1/467 124/87
5,080,084 A * 1/1992 Kendall ..... F41G 1/467 124/87
5,347,976 A * 9/1994 Saunders ..... F41G 1/467 124/87
7,040,027 B1 5/2006 Shaffer et al.
8,191,544 B2 * 6/2012 Buck ..... F41G 1/467 124/87
2013/0081292 A1 4/2013 LoRocco
2017/0082401 A1 3/2017 Wolf et al.

* cited by examiner

*Primary Examiner* — John Ricci
(74) *Attorney, Agent, or Firm* — Your Intellectual Property Matters, LLC; Robert A. Frohwerk

(57) ABSTRACT

This bow constrictor allows a peep sight or other device to be easily served in to a bowstring or bow cable without the expense and time-consuming services of a professional. A user simply splits the bowstring strands then inserts the bowstring constrictor with an associated device, guiding the bowstring through the grooves of the constrictor. The grooves couple the constrictor tightly to the bowstring applying minimal stress with minimal resultant wear. The attachment mechanism may be incorporated as a single unit into peep sights, knotting devices, cable weights or other devices of use to an archer or bow hunter. An independent, standalone version may also be used to spread and then constrict cable strands to support other items. Though designed to meet the needs of an archer or bow hunter with regard to a bowstring or bow cable, the described mechanism is scalable for other uses as well.

11 Claims, 18 Drawing Sheets

500
510
290
260
280

BOWSTRING CONSTRICTOR

CROSS-REFERENCES TO RELATED APPLICATIONS

This application claims benefit of U.S. Provisional Application No. 62/451,496, filed Jan. 27, 2017, entitled "Bowstring Constrictor", which is incorporated here by reference in its entirety.

TECHNICAL FIELD

The apparatus described here relates generally to an attachment to a compound archery bowstring or cable. A cable attached to a bow is made of the same substance as the bowstring, not of metal. Devices such as a peep sight, cable weight, kisser button, and clamps attach to the bowstring and cable.

BACKGROUND

A compound archery bow typically includes a pair of pulleys, with at least one of the pulleys having a cam surface to provide a mechanical advantage while drawing the bow. Typically, an archer will purchase a bow at a Pro Shop and frequently return the bow for tuning and maintenance. Once a bow (used or new) is purchased, there is a need to place a peep within the bowstring. The peep will have to be adjusted at perfect eye level before the archer can see the bow sight pins. After the peep is adjusted to the perfect eye level, the peep must be secured within the bowstring. A bowstring may consist of up to twenty plus individual strands of string to make a complete bowstring. Approximately one-half of the total bowstring will follow a groove on the peep, while the other half will follow the groove on the other side of the peep. If not properly secured, with a fast flight or other string material, the peep will move with ease. The peep must be "served" to secure it in place. The serving process takes time and skill. Usually Pro Shops do this process as a customer service associated with the purchase of a bow. The same process occurs when tying in a cord that attaches between the drop away rest and cable. Each time this process occurs, it costs both the customer and the dealer time and money.

BRIEF SUMMARY OF THE INVENTION

The embodiments described in this disclosure enable an archer to secure an eye piece, referred to as a peep sight, or simply a peep, on a bowstring without having to "serve" or secure it to the bowstring. The embodiments described are applicable to both bowstrings and bow cables. In this disclosure, a reference to a bow cord therefore may also be considered as being applicable to a bowstring or a bow cable.

Most peeps or other devices placed on a bow cord are clamped or served. Generally a peep is served in to hold it in place. If the peep moves up or down, the arrow will follow. It is very time consuming to tie-in or serve a peep. With a bowstring constrictor, there is no longer a need to serve or clamp a peep, or any other apparatus mounted on a bow cord. The bowstring generally splits in half as one side follows the groove on one side of the peep, and the other follows the groove on the other side. With one side of the string wrapped around a helical groove or peg past the distal end of the peep sight, and the other side doing the same, the peep sight is constricted in place and will not move. Once the bow limbs are collapsed, the peep can then move freely due to no constriction between the bowstring and the helical groove and pegs at the distal end of the peep. After the bow limbs have been released, the string tightens and wraps around the grooved stems circulating around the peep. The constriction of the parted bowstring wrapping around the helical grooves of the peep stems holds any apparatus from moving up or down on the bowstring or cable. In addition to a peep being secured by this method, a weight may conjoin to the stems, and be placed on the top and bottom of the bowstring (closest to the cam) to enhance arrow speed.

Another use for this method is to secure a drop-down rest cord to the bow cable. Common current designs require that the drop-down rest cord be served-in, or crimped by a clamp with a screw, in order to secure the position of the drop-down rest cord to the cable. The other option is to serve the end of the drop-away cord to the cable. This is very time consuming and requires experimentation. The need to quickly install a peep, weight, or drop-down rest cord is paramount for the end user or employee of the Pro Shop in terms of time, money, and functionality. With the design described here, the bow cord wraps around the captured device in a helical motion, and holds in place, any apparatus deemed necessary to aid the archer.

BRIEF DESCRIPTION OF THE DRAWINGS

Particular features and advantages will become apparent from the following description taken in conjunction with one or more of the accompanying FIGS. 1-55 of the drawings:

FIG. 5 is a front perspective view of the connector;

FIG. 6 is a rear perspective view of the connector of FIG. 5;

FIG. 7 is a front view of the connector;

FIG. 8 is a top view of the connector;

FIG. 9 is a bottom view of the connector;

FIG. 10 is a right side view of the connector;

FIG. 11 is a back view of the connector;

FIG. 12 is a left side view of the connector;

FIG. 13 shows a twisted bowstring split apart generally in equal portions preparatory to laying each portion into a groove of the connector;

FIG. 14 is a right side view showing the portions of the split bowstring laid into respective grooves of the connector;

FIG. 15 is a section view taken from FIG. 14 of a connector installed on a bow string or cable, from the top of the base looking down;

FIG. 16 is a section view taken from FIG. 14 of a connector installed on a bow string or cable, from mid-span looking down;

FIG. 17 is a section view taken from FIG. 14 of a connector installed on a bow string or cable, from the free-end of the stems looking up;

FIG. 18 is a front perspective of the connector, illustrating a helical groove formed counter-clockwise at left and another helical groove formed clockwise at right;

FIG. 19 is a front perspective view of the connector of FIG. 5, contiguously grooved and conjoined to a bowstring weight;

FIG. 20 is a back perspective view of the weighting device of FIG. 19;

FIG. 21 is a front view of the weighting device;

FIG. 22 is a top side view of the weighting device;

FIG. 23 is a right side view of the weighting device;

FIG. 24 is a back view of the weighting device;

FIG. 25 is a bottom view of the weighting device;

FIG. 26 is a left side view of the weighting device;

FIG. 27 is a front perspective view of the connector of FIG. 5 conjoined with a peep sight;

FIG. 28 is a back perspective view of the peep-sighting device of FIG. 27;

FIG. 29 is a front view of the peep-sighting device;

FIG. 30 is a top view of the peep-sighting device;

FIG. 31 is a right side view of the peep-sighting device;

FIG. 32 is a back view of the peep-sighting device;

FIG. 33 is a bottom view of the peep-sighting device;

FIG. 34 is a left side view of the peep-sighting device;

FIG. 35 is a front perspective view of the connector of FIG. 5 conjoined with a knotting device;

FIG. 36 is a back perspective view of the knotting device of FIG. 35;

FIG. 37 is a front view of the knotting device;

FIG. 38 is a bottom view of the knotting device;

FIG. 39 is a right side view of the knotting device, further illustrating connection to a drop-away rest cord;

FIG. 40 is a back view of the knotting device;

FIG. 41 is a top view of the knotting device;

FIG. 42 is a left side view of the knotting device;

FIG. 47 is an isometric view of the bottom of a peep sight attached to a bowstring;

FIG. 48 is a section view taken from FIG. 47 showing the path followed by a pair of strands of a bowstring winding through the helical grooves of the peep sight device and contiguous stems;

FIG. 49 is a top view of a double-ended connector used as a knotting device to show the path followed through the device by the bowstring strands;

FIG. 50 is a bottom view of the double-ended connector of FIG. 49;

FIG. 52 is a right side view showing the bowstring and bow cable connector of FIG. 5, and an exemplary separately manufactured bowstring or cable device;

FIG. 53 is a flow diagram of the manufacturing process for forming a functional weighting device;

FIG. 54 is a flow diagram of the manufacture of a functional peep sight; and FIG. 55 is a flow diagram of the manufacture of a functional knotting device.

Figure 1:
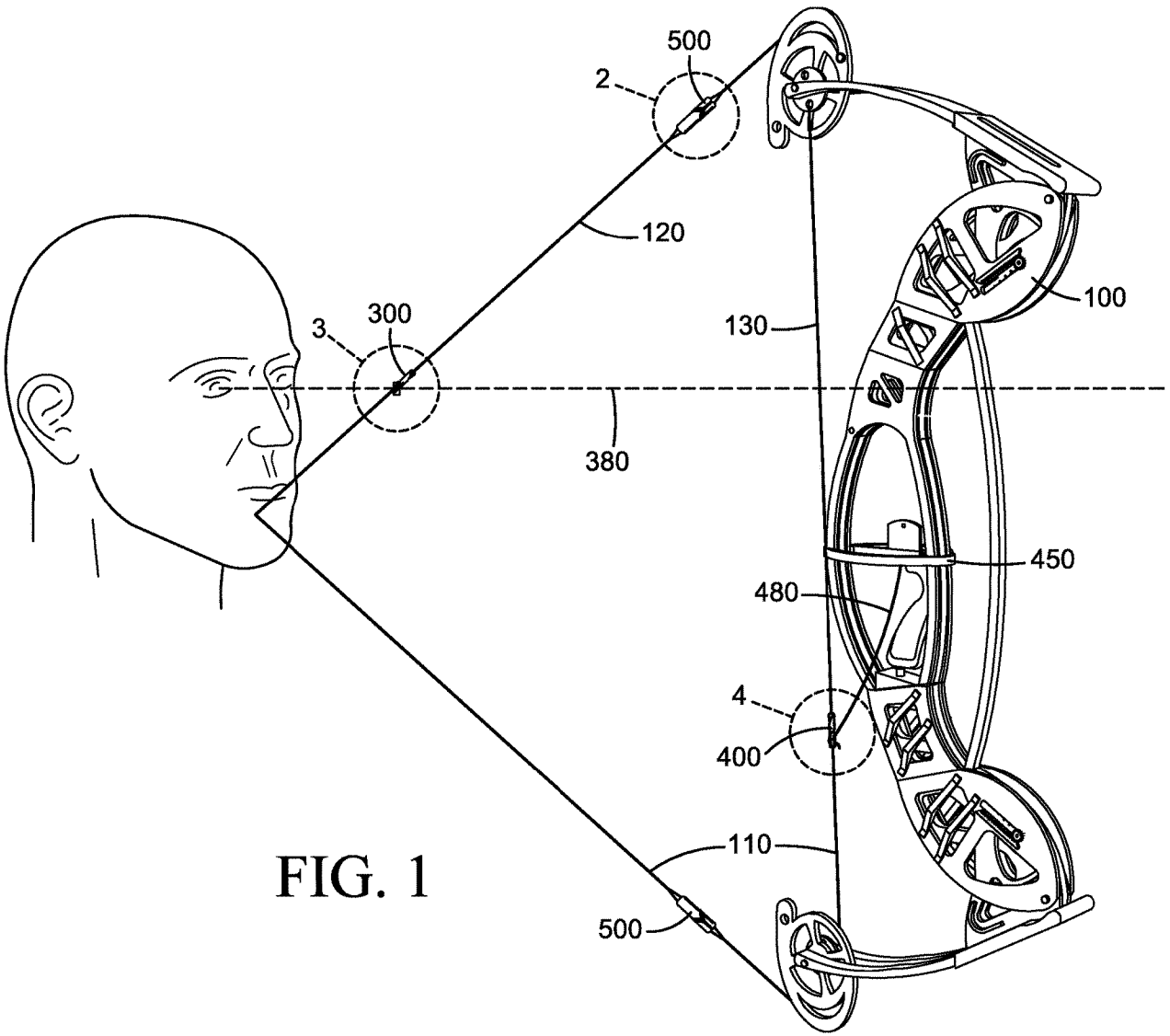
FIG. 1 is a side perspective showing various embodiments in an archery environment.
Figure 55:
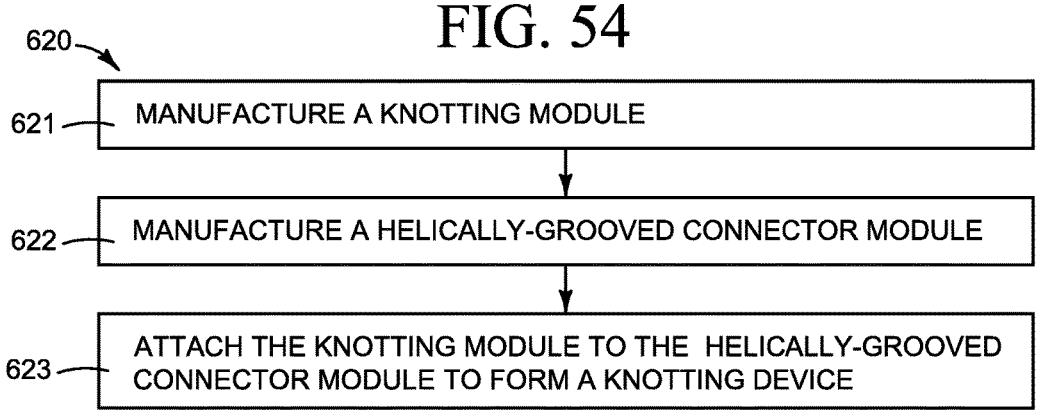

The following Reference Numbers may be used in conjunction with one or more of the accompanying FIGS. 1-55 of the drawings:

100 bow
110 bow cord
120 bowstring
130 bow cable
140 strand
200 accessory device
210 accessory device body
220 connector
230 device mounting face
235 device attachment face
240 connector base
245 stem mounting face
250 stem attachment face
260 stem
280 helical groove
290 flute
295 extended groove
300 peep sight
310 peep sight body
350 sight bore (peep bore?)
380 line of sight
400 knotting device
405 knotting device, double-ended
410 knotting device body
415 knotting device body, double-ended
420 knotting device aperture
450 drop-away rest
480 accessory cord, drop-away rest cord
500 weighting device
510 weighting device body

DETAILED DESCRIPTION

A bow 100 as used in archery is depicted in the side perspective view of FIG. 1. The system as shown includes various accessory devices attached to bow cords 110. The focus of this discussion will be on the attachment mechanism by which the accessory devices are connected to the bow cords 110, whether those cords be a bowstring 120 used to propel an arrow, or a bow cable 130 which is used to tension the bow.

In the figure an archer draws a bowstring 120 to which a weighting device 500 (FIG. 2) is attached. The extra weight on a bowstring is used to enhance arrow speed. A peep sight 300 (FIG. 3) includes an aperture serving as a sight bore 350 to provide the archer with a line of sight 380 directly through the middle of the bowstring 120 to see a bow sight that is attached to the bow.

A drop-away rest 450 attached to the bow 100 supports an arrow as the archer prepares to draw the bowstring 120. An accessory cord 480, used in this case as a drop-away rest cord, is connected at one end to the drop-away rest 450. The other end of the accessory cord 480 is tied into a knotting device 400 (FIG. 4) which is attached to the bow cord 130. As the archer draws the bowstring 120 the bow cable 130 moves downward taking with it the knotting device 400 which pulls the accessory cord 480 downward causing the drop-away rest 450 to drop support away from the arrow. This allows the arrow fletching to clear the forks of the rest to avoid all contact between the arrow fletching and the rest so as to not impede the arrow's flight path at the time that the bowstring is released. After the bowstring is released, the bow cable 130 retreats upward and the drop-away rest 450 is allowed to flatten parallel to the riser shelf.

Figure 2:
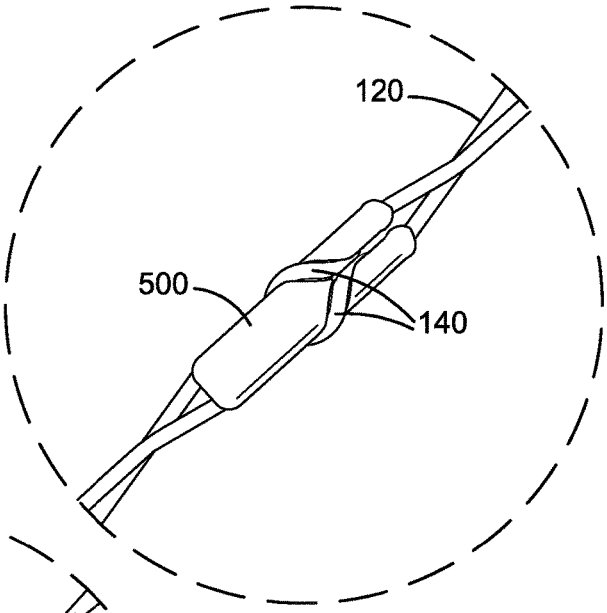
FIG. 2 is a detail view taken from FIG. 1 showing a weight attached to a bowstring.
Figure 3:
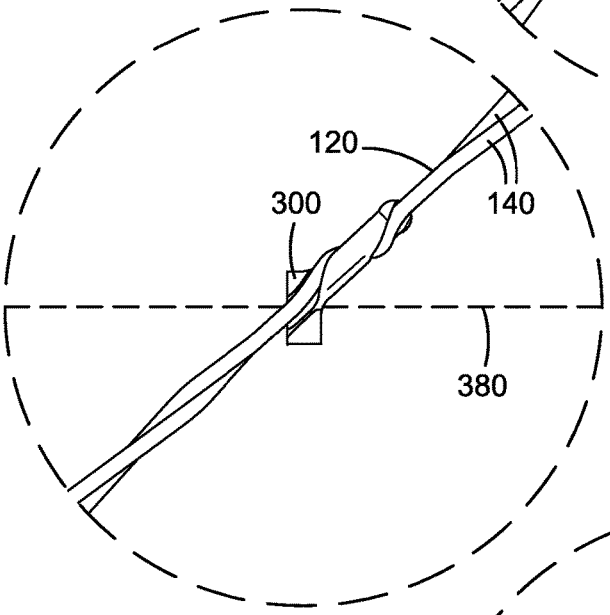
FIG. 3 is a detail view taken from FIG. 1 of a peep sight attached to a bowstring with an archer's line of sight indicated.
Figure 4:
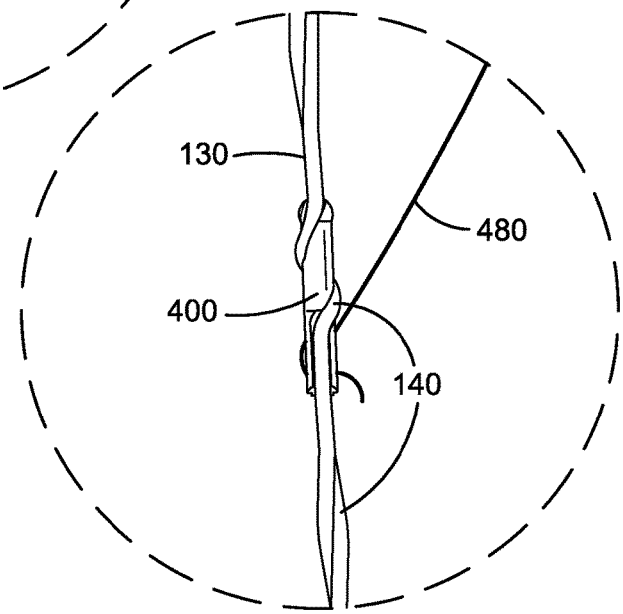
FIG. 4 is a detail view taken from FIG. 1 of a knotting device attached to a bow cable.

As can be seen in FIGS. 2-4 each of the devices described above is attached to a bow cord 110 by a specialized attachment device. The weighting device 500 and the peep sight 300 are attached to the bowstring 120, whereas the knotting device 400 is attached in this instance to the bow cable 130. In each of these cases the attachment is secured by a special connector of the present design.

A bow cord 110, whether a bowstring 120 or bow cable 130, is made of numerous strands 140 of material, generally a fiber or filament. For installation of a peep sight into a bowstring, generally the bowstring is split into two portions, usually by equal numbers of strands, and the peep sight is set into the opening between the split portions of bowstring material. A "serving", in the form of a thin string or band, is then wrapped around the bowstring above and below the peep sight to secure it to the bowstring. This process is time consuming and complex; it usually requires a highly trained Pro Shop individual to administer. Peep sights generally have a groove on their peripheral edge to accommodate the bowstring. The attachment mechanisms described here eliminate the need for serving a peep sight into a bowstring.

Another common accessory used on a bowstring is a weighting device for enhancing the speed of the arrow. FIG. 2 shows a weighting device conjoined with a connector to form a functional weighting device without requiring that it be served into the bowstring. It is especially desirable to avoid serving the bowstring near the cams of a compound bow, such as that shown in FIG. 1. Serving near the cam area requires that reinforcement material be added to the bowstring to prevent scarring in areas where the brass clamps and other accessories are placed.

Also depicted in FIG. 1, with a detailed view in FIG. 4, is a small accessory platform known as a knotting device. This is conjoined to an attachment mechanism for ease of attachment to the bow cable 130. The anchoring device supports an accessory cord 480 connection between the drop-away rest 450 and the bow cable 130.

Figure 5:
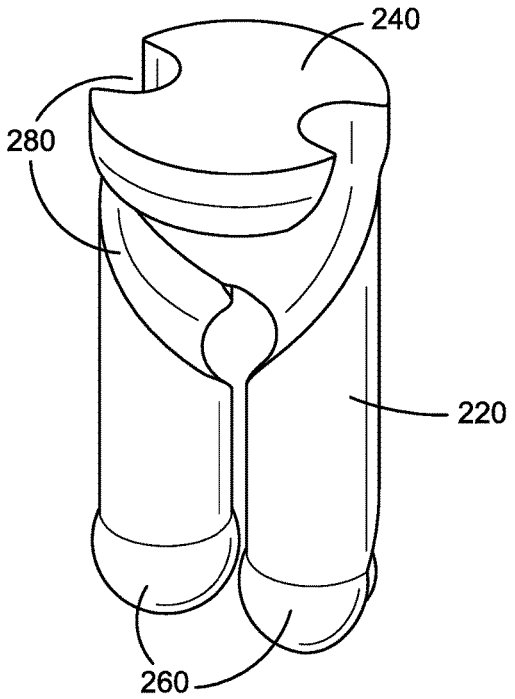
FIGS. 5-18 show various forms of a connector comprising two stems joined by a base having bilateral helical grooves for receiving parted portions of a bowstring or bow cable for attaching weights, peep sights, knotting and other devices to the bowstring or bow cable.
Figure 6:
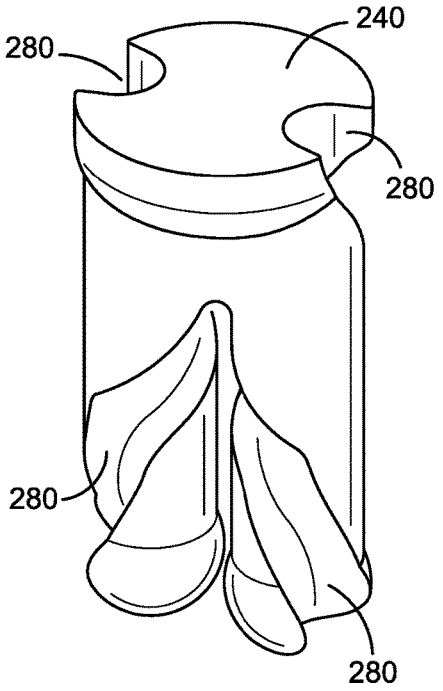

A connector 220 is shown in the front and back perspective views of FIGS. 5-6, respectively, where two stems 260 are conjoined into the connector. In situations where it is desirable to have two or more stems conjoined to a connector, it is preferable that each be properly attached off-center with respect to the connector so as to form a symmetrical assembly. The stems 260 of the connector show a helical grove 280 starting from the stem mounting face 245 at the end proximal to the connector and continuing to the distal end of the stem. Where two stems are conjoined into the connector, as shown here in FIGS. 5-6, each will be a mirror image of the other, and therefore each will have a helical groove that has a left- or right-handedness opposite that of the helical groove of the other. Further detail for a single stem 260 is shown in general terms at FIGS. 51-52.

Figure 8:
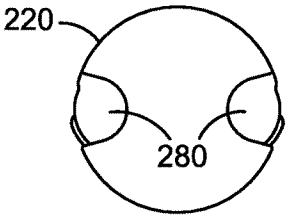
Figure 7:
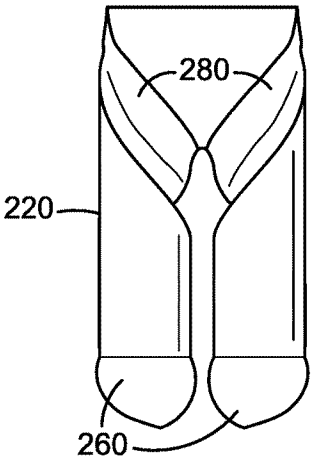
Figure 10:
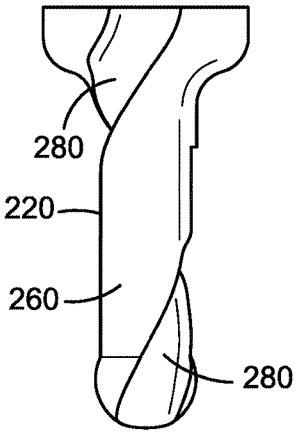
Figure 11:
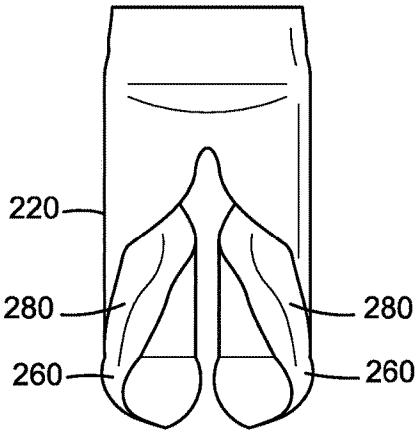
Figure 12:
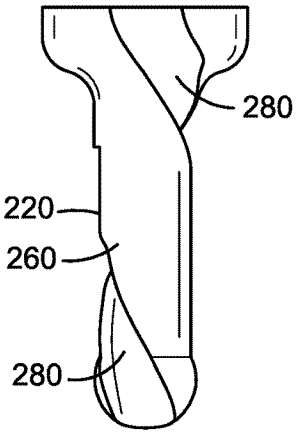
Figure 9:
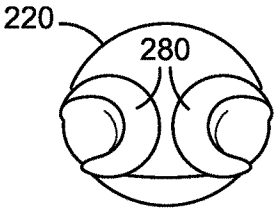

FIG. 8 is a top view of the connector 220. This is the proximal end of the stems 260 where the helical groove 280 begins. The distal end of the stems 260 are shown in FIG. 9, at which point the helical groove 280 terminates. The groove at the proximal end of the connector will be at zero degrees, and will continue to escalate in degrees of rotation as it reaches the distal end of the stems 260. The degree of angle of rotation of the groove commencing from the proximal end of the connector may be in the range of 0 degrees to 360 degrees or any positive or negative co-terminal degree past a 360 degree around the stems or connector.

FIGS. 7, 10, 11, 12 show the connector 220 in front, right side, back and left side rotations, respectively, the helical groove 280 appearing in each view. As string pressure is increased in the helical groove, constriction of the bowstring 120 increases around the connector 220.

Figure 13:
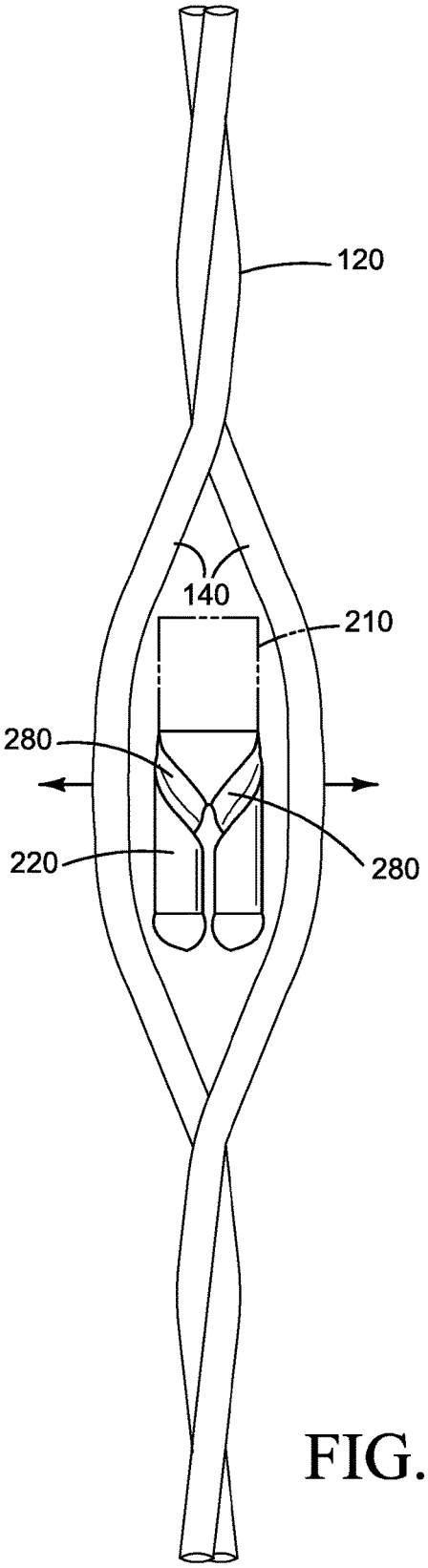
Figure 14:
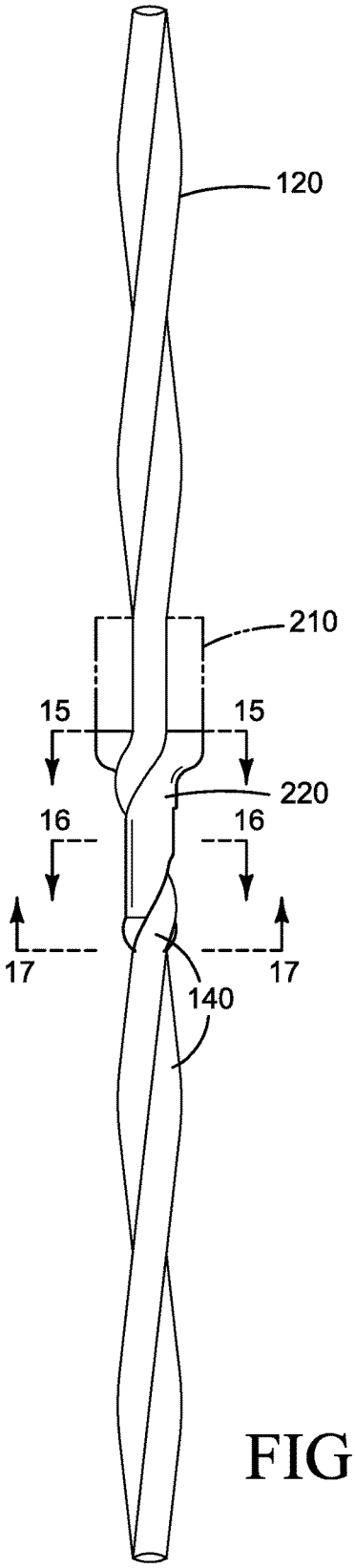

A twisted bowstring 120 is shown in FIG. 13 and FIG. 14. These figures clearly show the strands 140 of the bowstring split apart in generally equal portions preparatory to laying each portion into a helical groove 280 of the connector 220 or stems 260. The right side view of FIG. 14 shows the strands 140 of the split bowstring 120 laid into respective helical grooves 280 of the connector 220. Applying tension to the bowstring 120 will cause the strands 140 to constrict around the helical grooves 280 of the connector, locking the connector 220 onto the bowstring 120, along with any accessory device body 210 that is attached to the connector.

Figure 15:
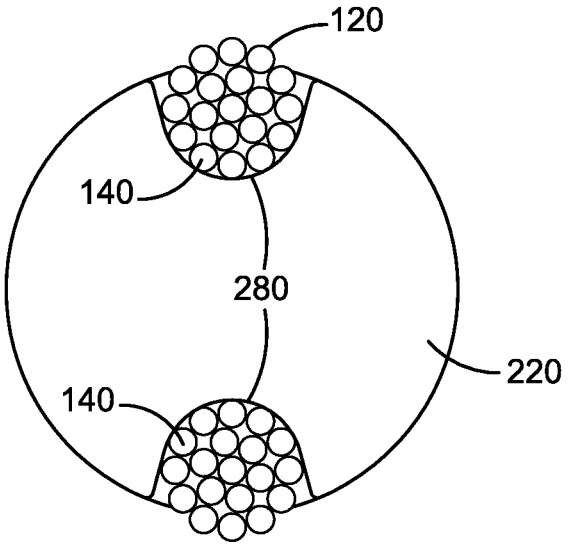
Figure 16:
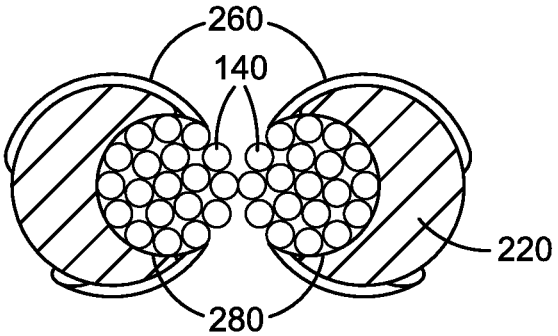
Figure 17:
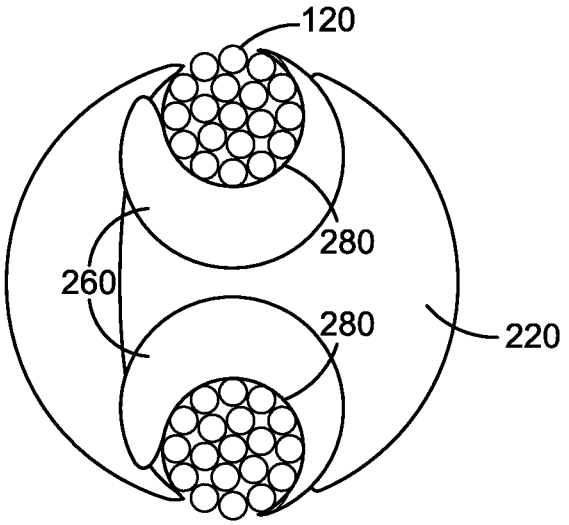

FIGS. 15-17 show progressive stages of the split string strands 140 rotating within the helical groove 280, from the proximal end, mid-span, and distal end of a pair of stems 260. The split string starts at 0 degrees at the proximal end of the connector (FIG. 15), and continues to rotate through the mid-span (FIG. 16) until exiting at the distal end of the stems 260 at FIG. 17. The extent of rotation can be from 0 to 360 degrees, or any co-terminal degree past a 360 degree rotation around the stems. Multiple stems with helical grooves can conjoin with any apparatus such as a peep sight, weighting device, or knotting device.

Figure 18:
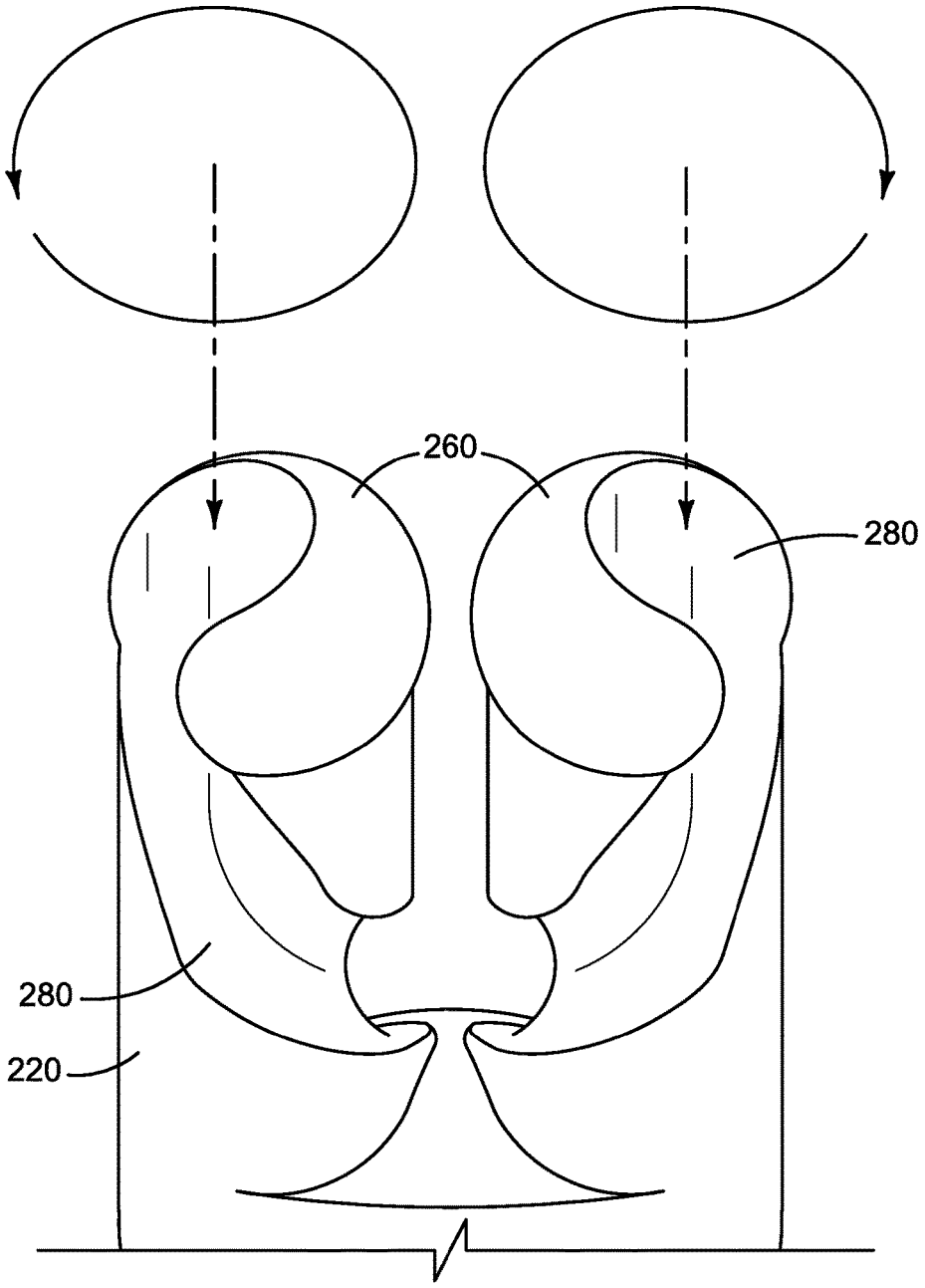

A bottom perspective of the connector 220 is shown in FIG. 18 to illustrate a helical groove 280 formed counter-clockwise at the left and another helical groove formed clockwise at the right. Each of the two strands 140 of the split bowstring will follow one of the helical grooves 280. Greater tension on the bowstring correlates directly to how securely the connector, and any apparatus attached thereto, is held in place.

Figure 19:
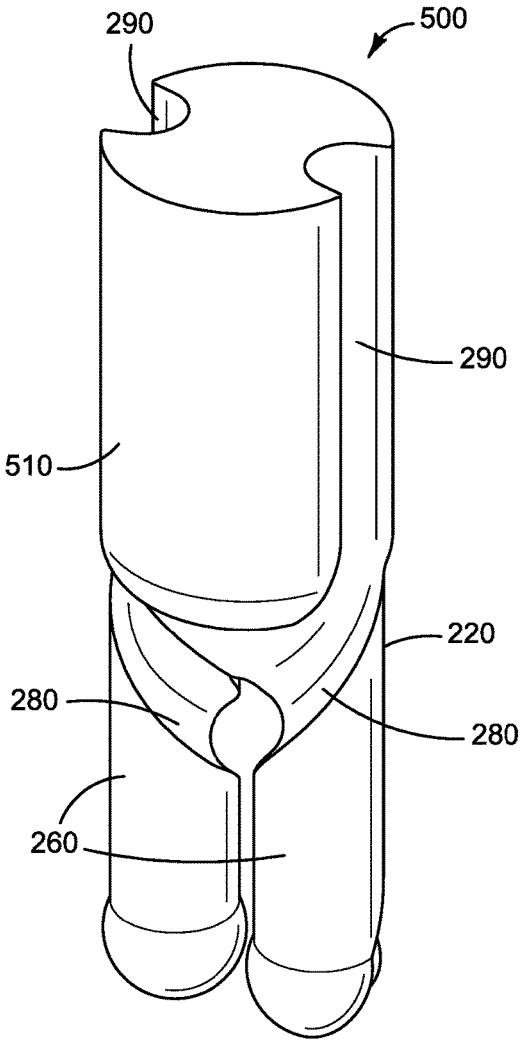
FIGS. 19-26 show the connector of FIG. 5 conjoined to a bowstring weight.
Figure 20:
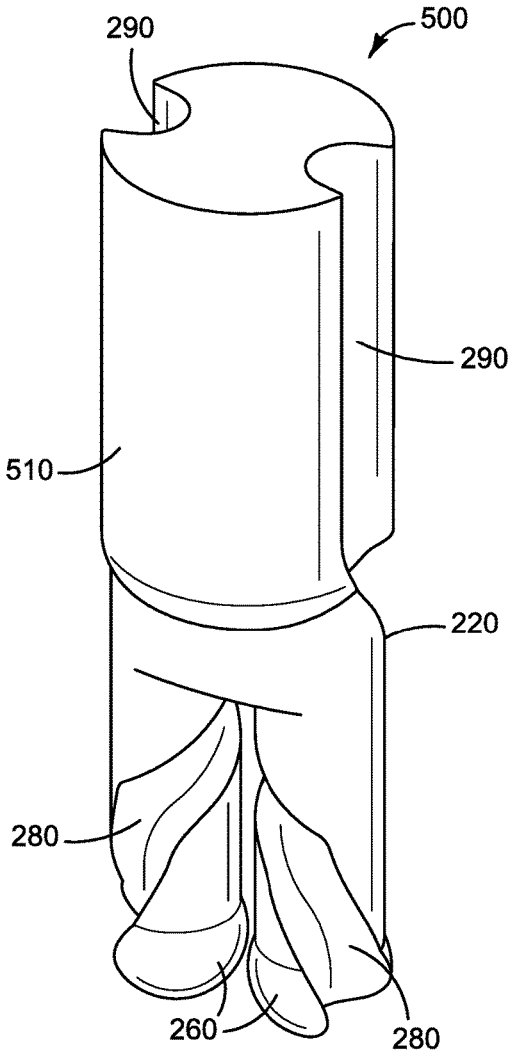

At FIG. 19 is seen a front perspective view of the connector of FIG. 5, now contiguously grooved and conjoined to a bowstring weighting device body 510. When installed onto a bowstring, weighted portion rests closer to the mechanical pulley, or cam. A back perspective view of the weighting device 500 appears in FIG. 20.

Multiple views of the weighting device 500 are shown in FIGS. 21-25 where stems 260 are conjoined to the weighting device body 510. Conjoining may be accomplished through many processes, such as by molding, gluing, stamping, threading, clamping, ultrasonic welding, or by any methodology that is useful to merge the individual entities. The weighting device body 510 attaches at the proximal end of the stem 260. The helical groove 280 moves in a circular momentum throughout the length of the stem. The degree of angle of rotation of the groove from the proximal end of the stem, to the distal end of stem, may be 0 to 360 degrees, or any co-terminal degree past a 360 degree around the stem. The complete weighting device 500 fits between strands 140 of the bowstring 120 and is suspended by the inward pressure of the separated strands of the split bowstring. The weighting device body 510 and the proximal end of stem 260 may be connected (conjoined) during the mold process, or by additive or subtractive manufacturing processes. A helical groove 280 starts at the proximal end of the stem and rotates in a forward momentum until it egresses at the distal end of the stem. This rotation is shown in the sequence of FIGS. 21, 23, 24 and 26, from front, right side, back and left side views, respectively.

Figures 21, 22, 23, 24, 25, 26:
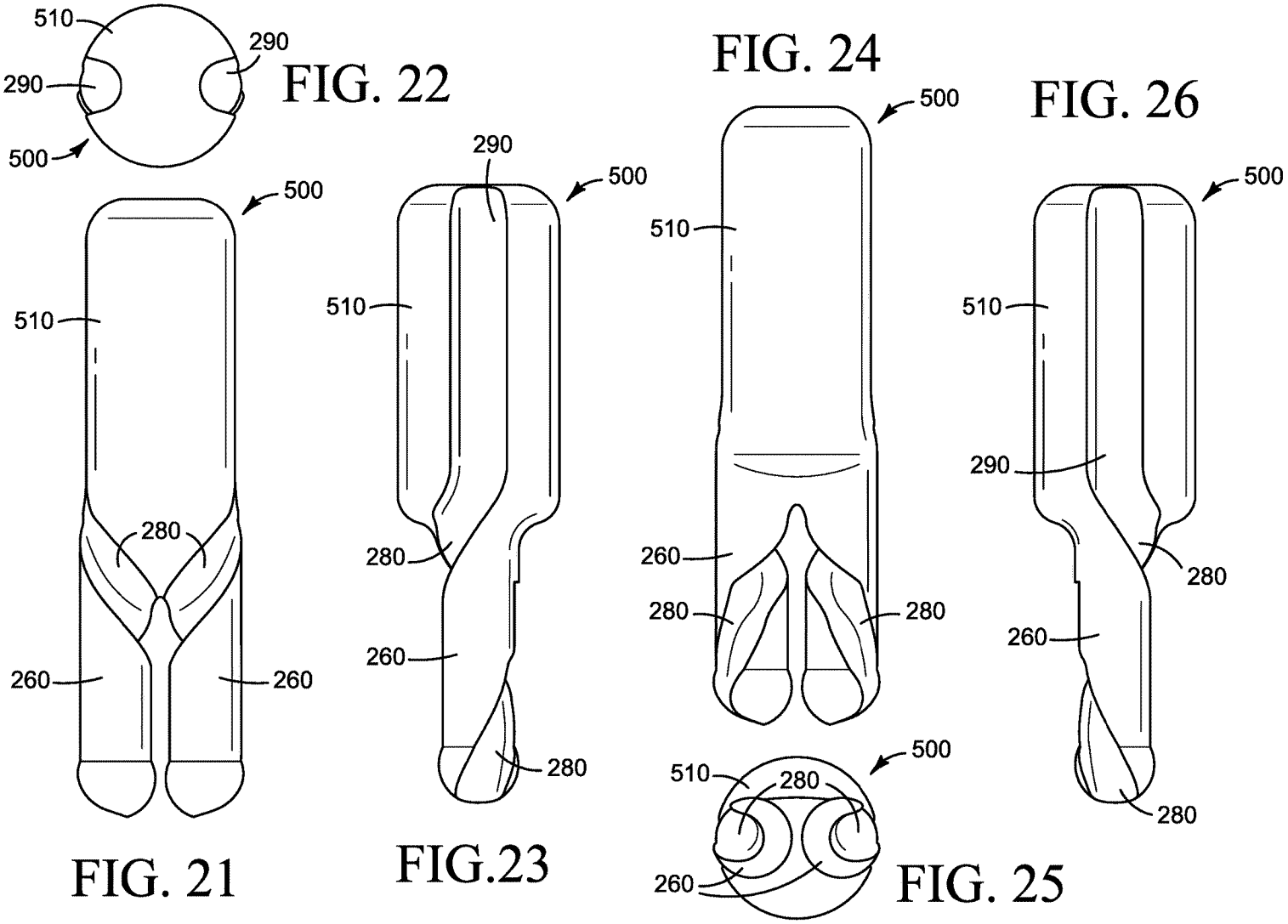

The top view of the weighting device 500 in FIG. 22 shows the flutes 290 which extend upward through the weighting device body 510 coaxially contiguous from the helical groove 280 which begins at the proximal end of the connector 220. Through the rotations shown, the helical groove 280 exits the distal ends of the stems 260 at FIG. 25.

Figure 27:
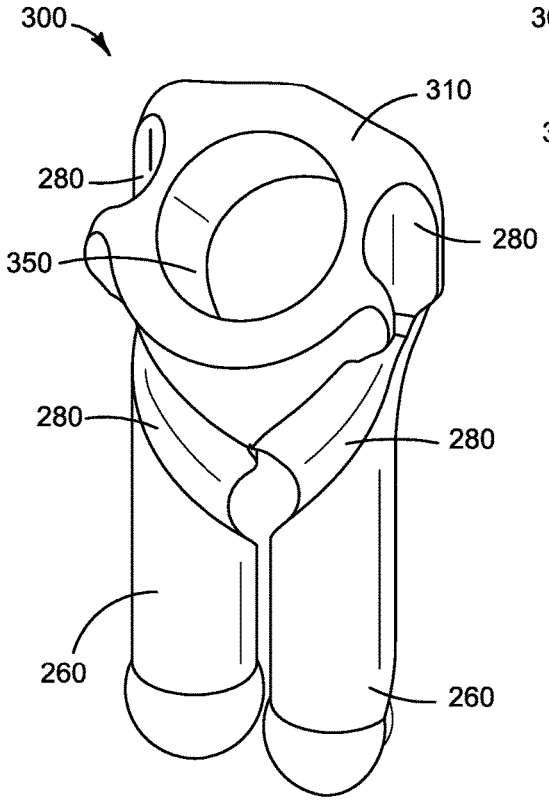
FIGS. 27-34 show the connector of FIG. 5 contiguously grooved and conjoined to a peep sight.
Figure 28:
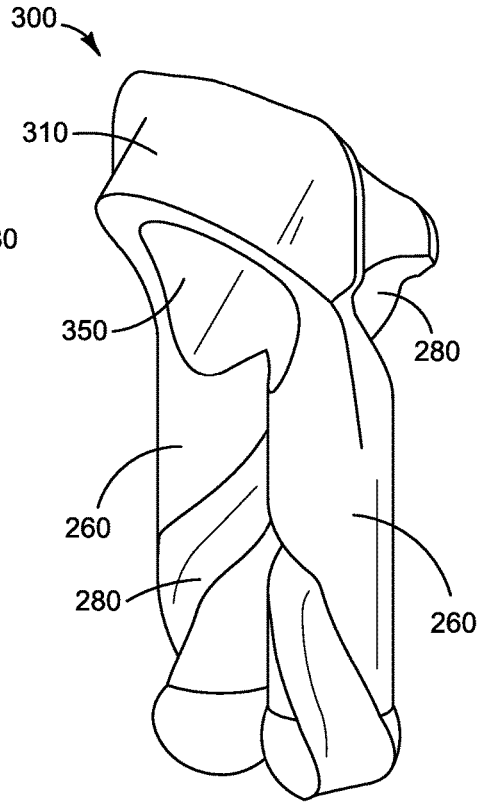
Figures 29, 30, 31, 32, 33, 34:
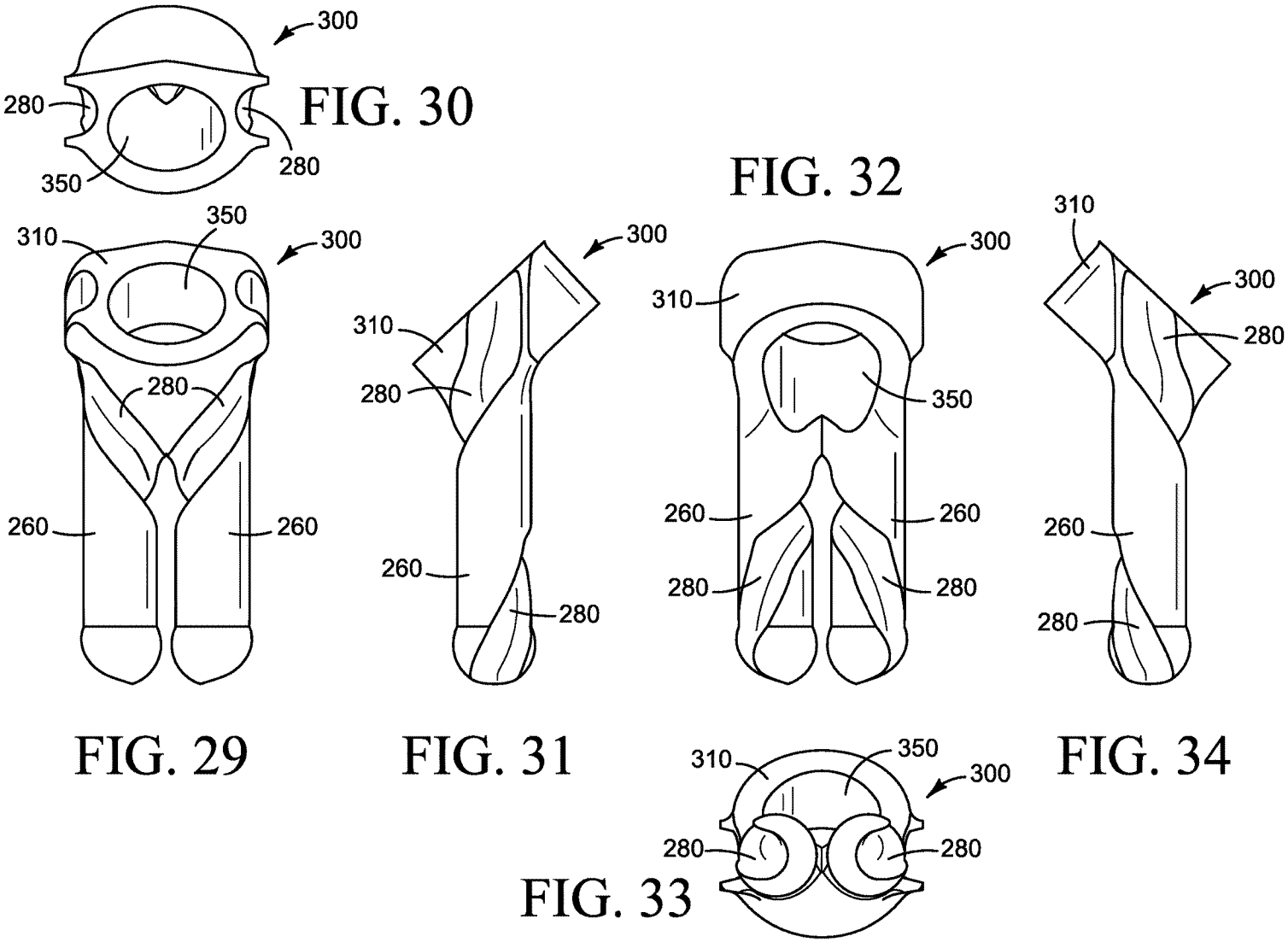
Figure 35:
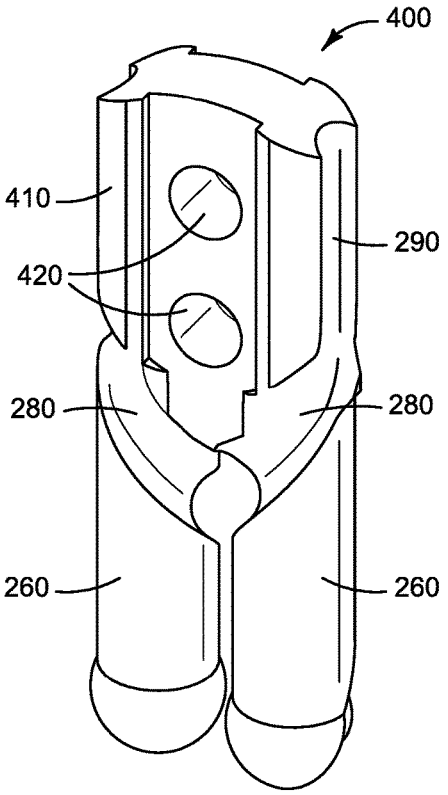
FIGS. 35-42 show the connector of FIG. 5 contiguously grooved and conjoined to a knotting device which connects a bow cable to a drop-away rest cord.
Figure 36:
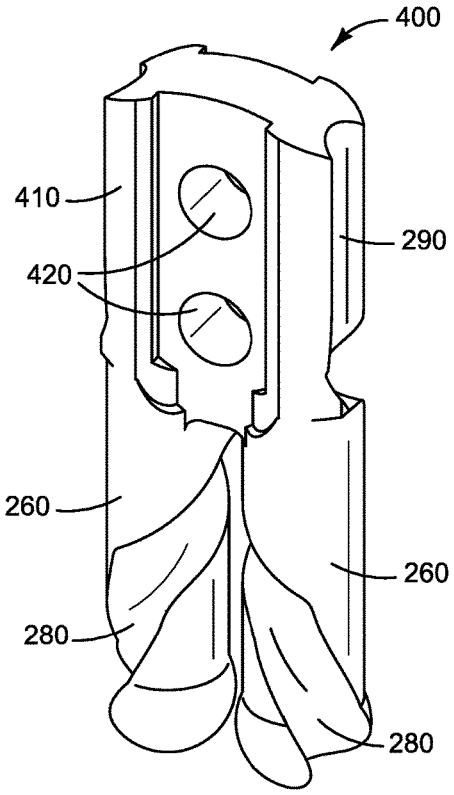
Figure 42:
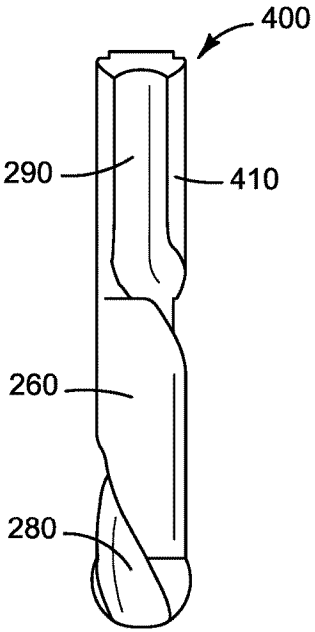
Figure 41:
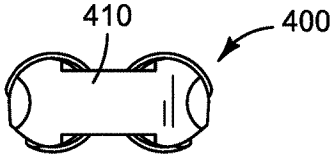
Figure 40:
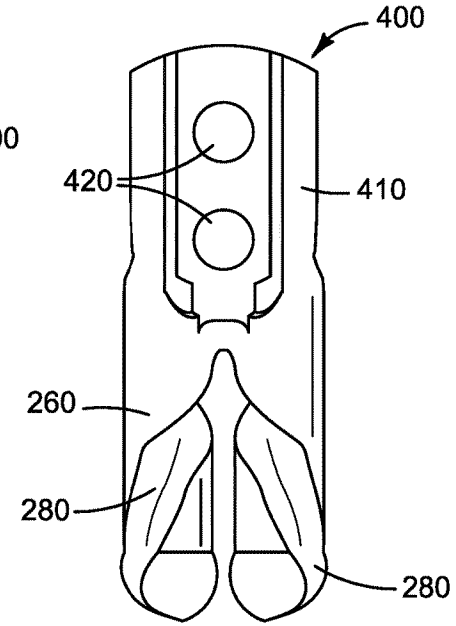
Figure 39:
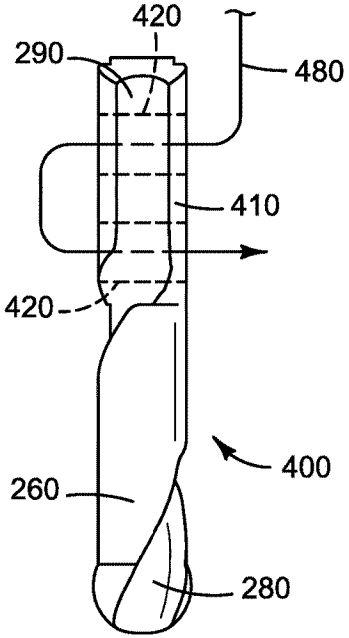
Figure 37:
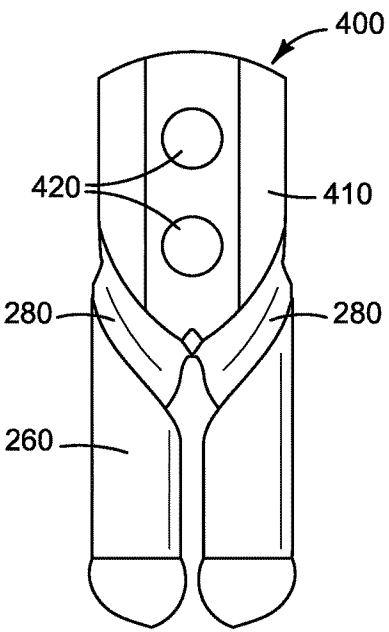
Figure 38:
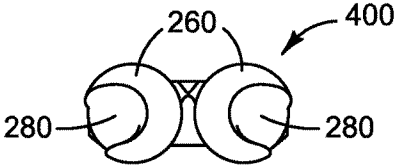
Figure 43:
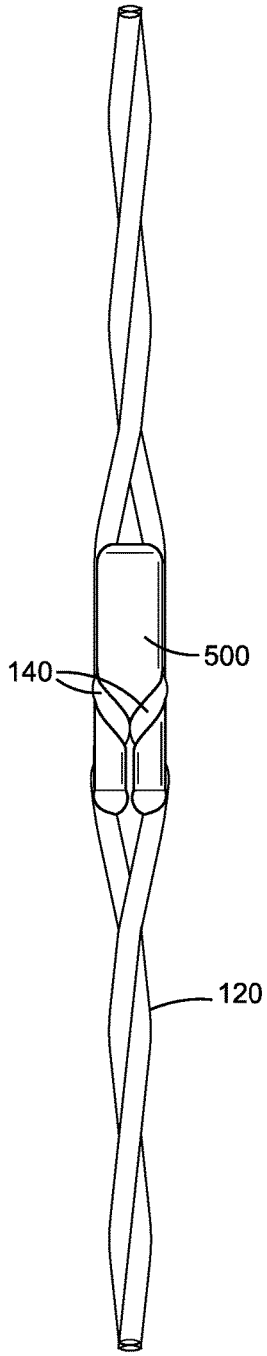
FIG. 43 is a front view of an exemplary connective device attached to a bowstring.
Figure 44:
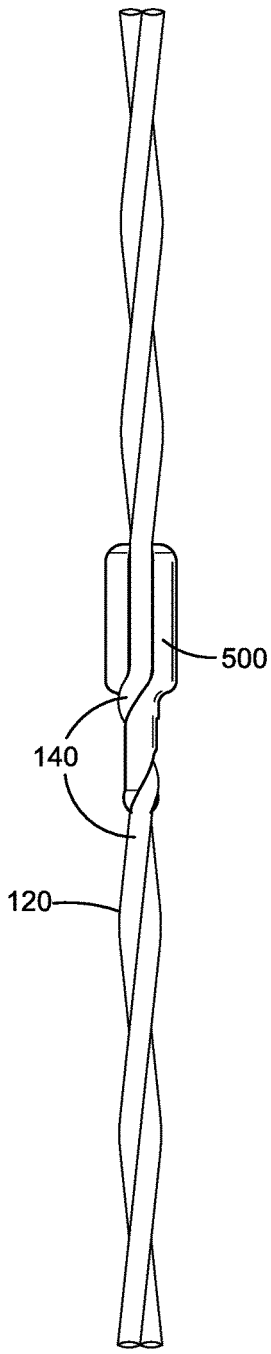
FIG. 44 is a left side view of the device of FIG. 43.
Figure 45:
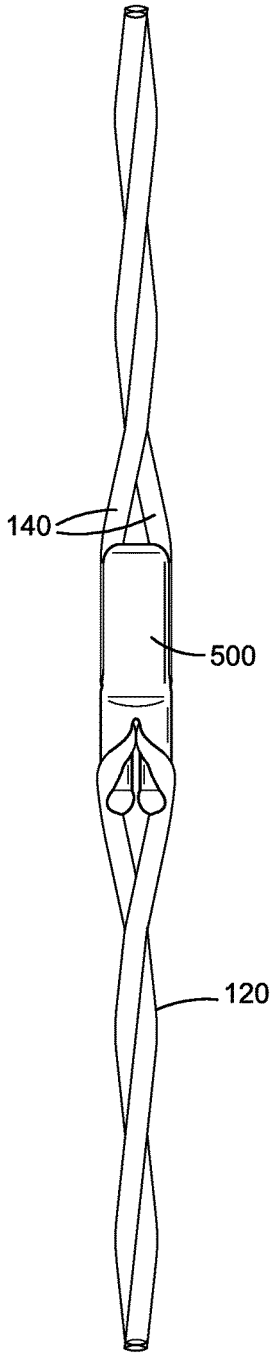
FIG. 45 is a back view of the device of FIG. 43.
Figure 46:
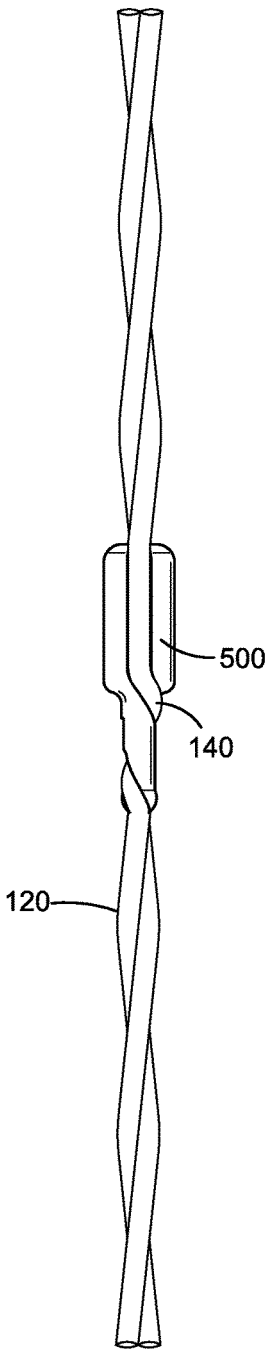
FIG. 46 is a right side view of the device of FIG. 43.

FIGS. 27-34 show collectively the connector 220 of FIG. 5 contiguously grooved and conjoined to form a peep sight 300. The front perspective view shown in FIG. 27 is of the connector 220 of FIG. 5 conjoined with a peep sight body 310. A normal peep sight would require a "serving" to keep it secure within a bowstring. However, the addition of stems 260 and connector 220 eliminate the need to "serve-in the peep". FIG. 28 is a back perspective view of the peep sight of FIG. 27. The peep sight body and 310 and stems 260 are conjoined as a single unit, a peep sight 300, ready for use in a serve-less application.

The peep sight body 310 and the stems 260 are shown conjoined in FIGS. 27-34. As with other configurations described above, the peep sight 300 may be constructed with one or more stems. Each stem 260 has a proximal end, a midpoint section, and a distal end. A groove surrounds the stem 260 to accommodate the bowstring 120. The peep sight body 310 has a see-through sight bore 350 that will locate in line with the archer's line of sight 380 (see FIG. 1). The groove begins as a flute 290 on the sides of the peep sight body 310 and extends through the top of the connector 220 at the proximal end of the stem 260. At the connector the flute 290 is coaxially contiguous with the beginning of the helical groove 280 which begins to rotate, wrapping around the stem 260 until it transcends to the distal end of the stem, the conjunction of the flute 290 with the helical groove 280 forming an extended groove 295. The degree of angle of rotation of the groove starting from the proximal end of stem, may be 0 to 360 degrees, or any positive or negative co-terminal degree past a 360 degree around the stem.

Another configuration of the connector of FIG. 5 is shown collectively in FIGS. 35-42. Here the connector 220 is contiguously grooved and conjoined to a knotting device body 410. In its completed form, a knotting device 400 is often used to connect a bow cable 130 to a drop-away rest cord 480, though any accessory cord may be tied into any bow cord 110 using this device. The knotting device 400 attaches to a cable on the bow (usually made from the same material as the bowstring) for the purpose of manipulating the drop away rest 450 (see FIG. 1). The knotting device body 410 includes a cord-receiving platform having one or more knotting device apertures 420 for holding a drop-away rest cord 480 securely between the bow cable 130 and the drop-away rest 450. When the bow is drawn, the cable will move down, pulling the drop-away rest cord 480 to release an attached drop away rest 450.

One or more knotting device aperture 420 through the knotting device body 410 accepts and secures a cord to the cable. A flute 290 on the sides of the knotting device body 410 continue coaxially into helical grooves 280 that are pronounced on the peripheral of the stems 260. The helical grooves 280 start at the proximal end of the stem 260 and continue their helical motion to the distal end of the stem. The degree of angle of rotation from the proximal end of the stem to distal end of stem may be 0 to 360 degrees or any co-terminal degree past 360 degrees around the stem. It may be noted that the groove on the outer surface of the stem may rotate clockwise or counter clockwise along the side of the stem.

FIGS. 43-46 show various views of an exemplary embodiment of the described accessory devices 200, in this case a weighting device 500, attached to a bowstring 120. The bowstring splits into separate strands 140 at the top end of the weighting device 500, descending in grooves which begin as flutes 290 on the edge of the weighting device body 510. The separate strands 140 continue to descend further, through the connector where they begin to run in a helical groove 280 located on the peripheral of the stem 260.

Figure 47:
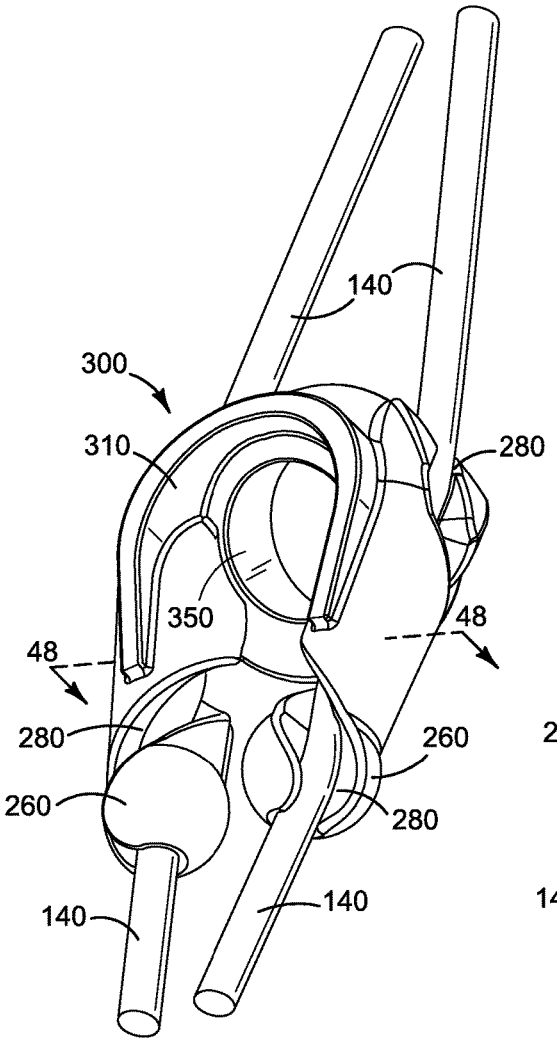
FIGS. 47-50 show devices produced as here described when attached to two strands of a bowstring or bow cord.
Figure 48:
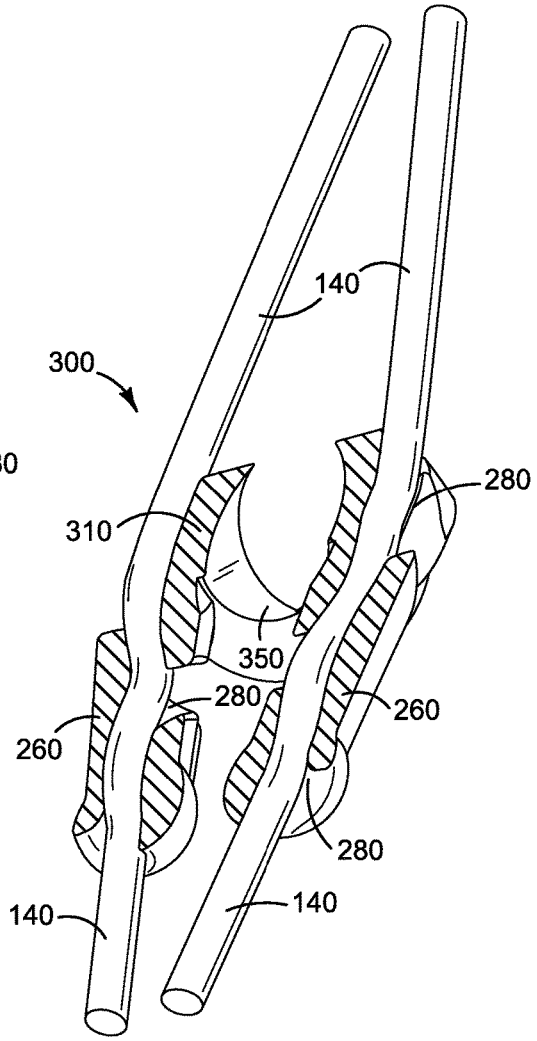

A peep sight 300 is shown in FIG. 47 where two strands 140 of the bowstring 120 pass through a pair of stems 260 each having a helical groove 280. The two stems are formed as mirror images of one another so that the helixes of the two helical grooves rotate in opposite directions. This is an alternate configuration to the designs shown here above. Whereas the discussion to this point has referred to helical grooves 280 winding around an outer surface of the stems 260, this design has the stem 260 wrapping around the strand 140. Here the helical groove 280 is formed on an internal surface of the stem 260, rather than being formed on an external surface of the stem as in the previous figures. The stem 260 guides the strand 140, forcing it to follow the helical groove. As seen in the cutaway of FIG. 48, an inward deflection of the helical groove 280 redirects the strand 140 as it is pulled taut, relieving pressure on the stem 260 since the strand is deflected instead of wrapping around the stem. Preventing the strand 140 from straightening causes it to apply even greater pressure to force adherence to the helical groove 280.

The cutaway view of FIG. 48 shows the strands 140 turning and twisting as they journey through the helical grooves 280. Tension increases within the strands 140 as they are subjected to turns within the helixes, generating friction which holds the peep sight 300 securely in place on the bowstring 120.

Figure 49:
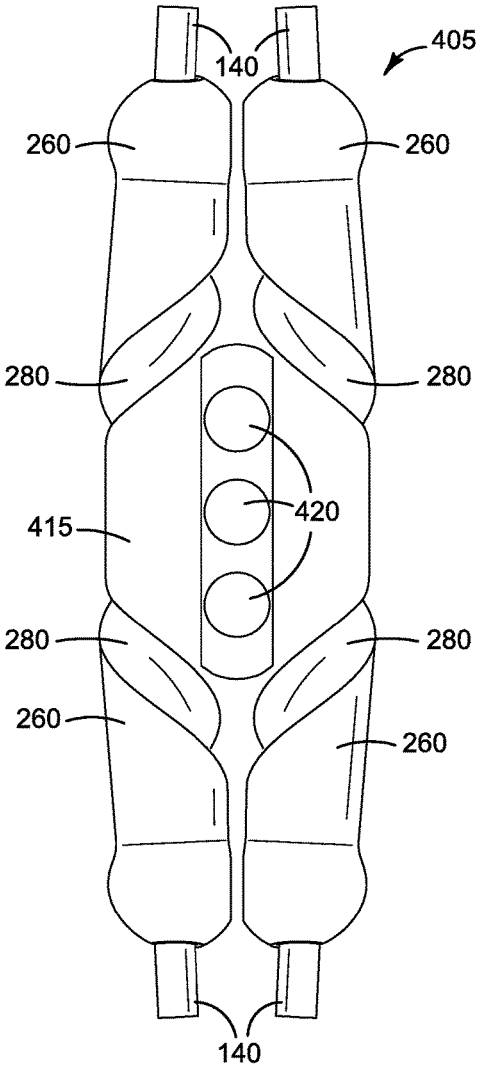
Figure 50:
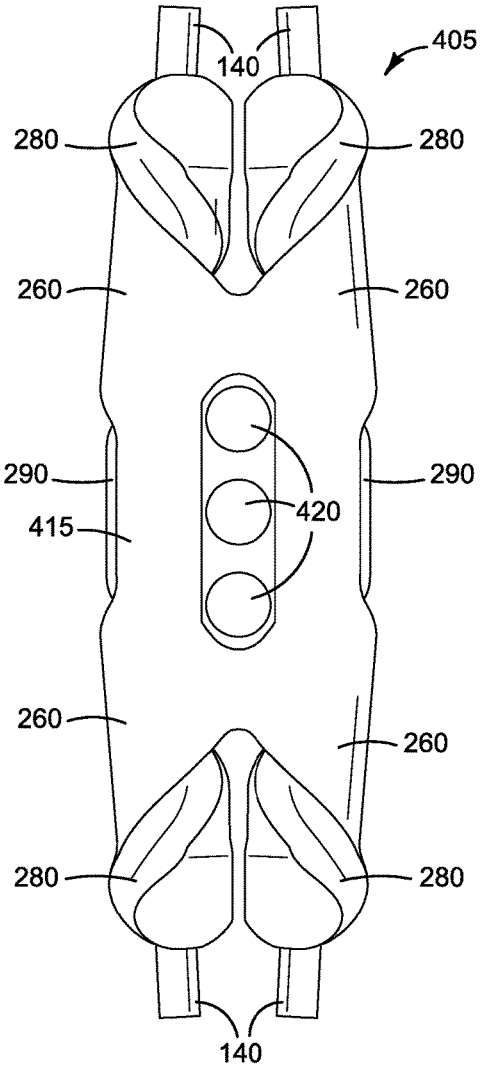

The double-ended version of a knotting device 405 is shown in the top view of FIG. 49, and bottom view of FIG. 50. This device incorporates two pair of stems 260, one pair of stems at each end of the device. As with the peep sight of FIGS. 47-48, the helical grooves 280 are internal to these stems 260 forcing an inward deflection as the strands 140 are pulled taut. After the strands 140 weave through the helical grooves 280 of a first pair of stems 260 at one end, they are directed into flutes 290 as they bypass the knotting device apertures 420 of the knotting device body 415. After passing through the flutes 290 the strands 140 are redirected as they encounter another set of the helical grooves 280 before exiting the second pair of stems 260. It is to be noted that the second pair of stems is a mirror image of the first pair so that a strand guided in a clockwise direction by a helical groove at the entrance of the device will be relieved at the flute and unwound in a counterclockwise direction at the exit of the device, and vice versa. This pathway puts considerable tension on the strands 140 resulting in an extremely secure connection of the knotting device 405 to the bow cable 130.

Figure 51:
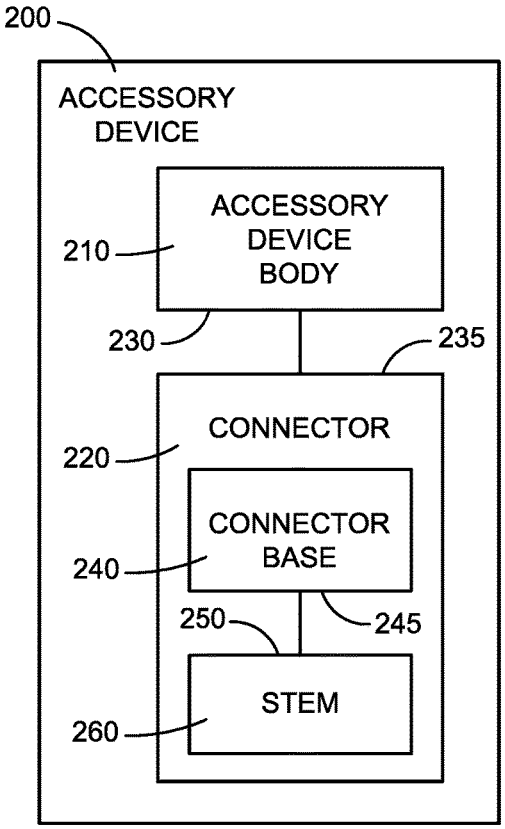
FIG. 51 is a block diagram of an accessory device as constructed from an accessory device body, a connector and a stem.

The block diagram of FIG. 51 shows the construction of a generic accessory device 200. A connector 220 is formed from a connector base 240 and one or more stems 260. Each stem is formed with a helical groove 280 extending the entire length of the stem. A stem attachment face 250 of the stem 260 is mounted to a stem mounting face 245 of the connector base 240 to form the connector 220. An accessory device body 210 is attached to the connector 220 by joining the device attachment face 235 of the connector to a device mounting face 230 of the accessory device body 235 to complete the accessory device 200. The joining of the accessory device body 210 to the connector 220 allows for these two modules to be constructed separately, though those familiar with these arts will recognize that the entire accessory device may be formed in a single unit by molding or other additive or subtractive manufacturing processes.

Figure 52:
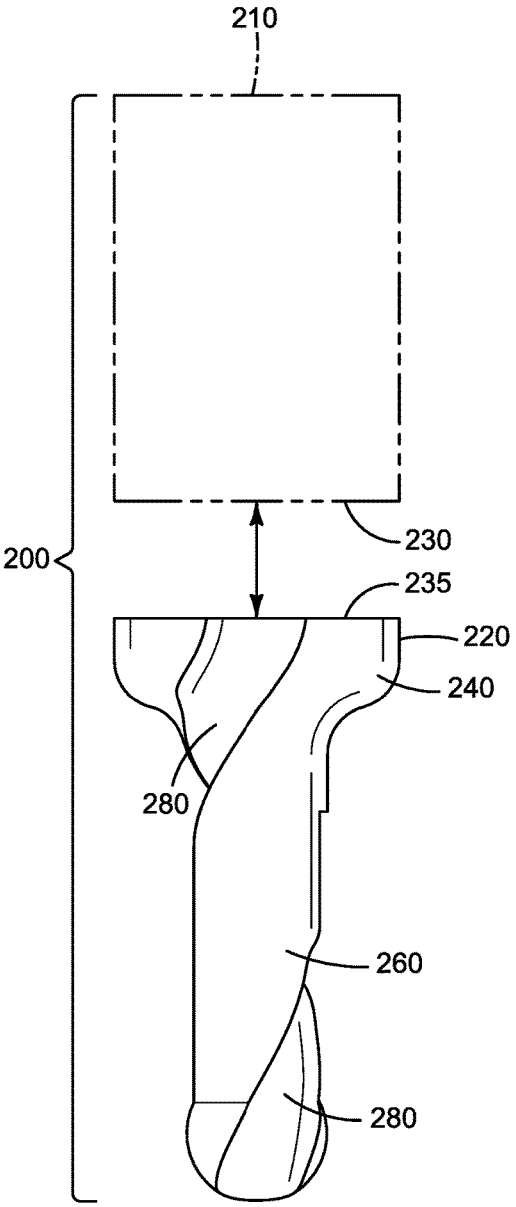
FIGS. 52-55 show one manufacturing process for producing the devices described herein in two parts, one part being a connector module and another part being any of a selection of bowstring or cable device modules, thereafter to be contiguously conjoined.

FIGS. 52-55 show one manufacturing process for producing the various accessory devices described here as two parts, one a connector 220 module and the other being any of a selection of device bodies 210. The right side view of FIG. 52 shows the connector to 220 of FIG. 5 and a generic accessory device body 210 thereafter to be contiguously conjoined.

Figure 53:
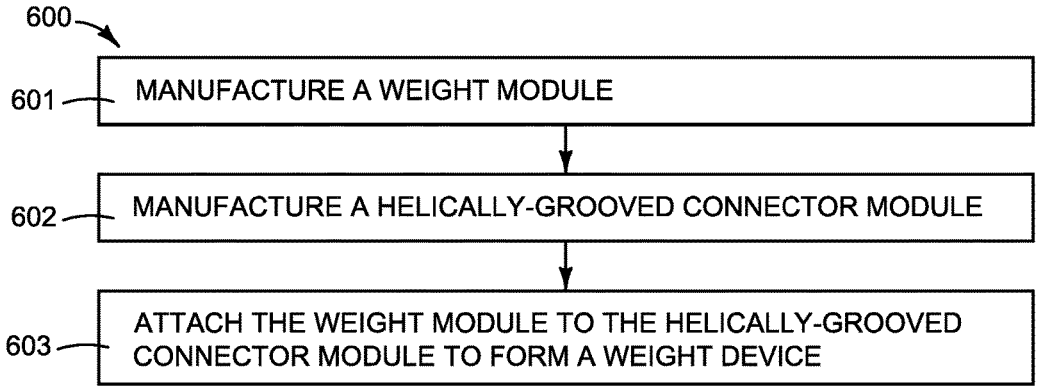
Figure 54:
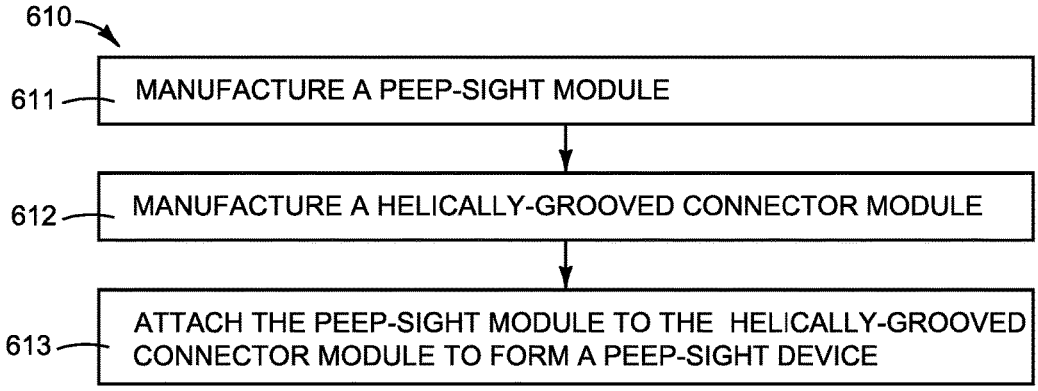

FIG. 53 is a flow diagram, showing the manufacturing process of a weighting device. The process begins with production of a weighting device body and of a connector having helically-grooved stems. The modules are then mutually conjoined to form a functional weighting device. FIG. 54 is a flow diagram, showing the manufacture of a peep sight module, and the manufacture of a helically-grooved connection module, the two modules being then mutually conjoined to form a functional peep sight. The flow diagram of FIG. 55 shows the manufacture of a knotting module, and of a helically-grooved connection module, followed by mutually conjoining the two modules to form a functional knotting device.

While this document has given specifics of three types of devices commonly used in archery, namely a peep sight, a knotting device, and a weighting device, these teachings may be extended to include any object that is to be attached to a bow cord. Other common devices that may be readily adapted based on these teachings include, but certainly are not limited to, a D-ring, a kisser button, and a silencer.

Those familiar with helixes, for example, in the form of screws or augers, will recognize that friction is increased, resulting in greater holding or cutting power, as the pitch, or the number of turns over a given length, is increased. For the devices described here, a trade-off is made to hold the accessory device securely to a bow cord as long as the cord is under tension but allowing for the device to be easily relocated or removed to when tension is released.

Though the devices and configurations shown here are all related to use in archery, it will be readily recognized that all are scalable. Therefore, the described attachment techniques and configurations may be used with larger, or smaller, cords than those typically used in bowstrings and bow cables. Furthermore, there is no reason to limit their structures to support of one or two strands, whereas three or more strands could be accommodated. Applications may certainly be found in any situation where it is desirable to insert an accessory device in line with a cord-like element that is held in tension. This may include applications ranging from maritime riggings to medical applications, and beyond.

It will be appreciated that the invention is not limited to the specific implementations described herein above merely by way of example. Those skilled in the art will recognize that various modifications may be made without departing from the spirit or scope of what is here described. Therefore, it is not intended that the invention be limited to the particular implementations disclosed insofar as variations can be made within the spirit and scope of the appended claims.

What is claimed is:

1. A connector for attachment to a bow cord, the connector comprising:

a connector base; and a first stem, wherein the bow cord comprises two or more strands, and wherein the bow cord is a bowstring or a bow cable, and wherein the connector base has a device mounting face and a stem attachment face, and wherein the first stem is attached at a proximal end to the stem attachment face of the connector base, and wherein the first stem includes a helical groove, the helical groove being accommodating to receive the bow cord, and wherein a distal end of the first stem is connectable to the bow cord by laying at least one of the two or more strands of the bow cord into the helical groove.

2. The connector of claim 1, further comprising a second stem, wherein the first stem is attached off-center to the connector base with respect to the device mounting face to accommodate attachment of a proximal end of the second stem to the stem attachment face of the connector base such that the second stem is a mirror image of the first stem, and whereby, due to the second stem being the mirror image of the first stem, a helical groove of the second stem has a left- or right-handedness opposite that of the helical groove of the first stem.

3. The connector of claim 2, wherein each helical groove rotates from a proximal end of each stem to a distal end of each stem through an angle in a range of 0 degrees to 360 degrees or any co-terminal degree above a 360 degree rotation around each stem.

4. An attachment mechanism incorporating the connector of claim 2 for attachment of an accessory device to the bow cord, wherein the accessory device is mounted to the device mounting face of the connector base, and wherein the helical groove of the first stem is accommodating to receive a first strand of the bow cord, and the helical groove of the second stem is accommodating to receive a second strand of the bow cord.

5. A peep sight incorporating the attachment mechanism of claim 4, for attachment to a bowstring, wherein the bow cord is the bowstring, and wherein the accessory device is a peep sight body, and wherein the peep sight body has a sight bore extending through the peep sight body, the sight bore enabling a line of sight from an archer between the two or more strands of the bowstring, and wherein the helical groove of the first stem is formed contiguously around the peep sight body, and the helical groove of the second stem is formed contiguously around the peep sight body.

6. A weighting device for attachment to the bow cord, wherein the accessory device of claim 4 is a weighting device body.

7. A knotting device incorporating the attachment mechanism of claim 4, for attachment to the bow cord, wherein the accessory device is a knotting device body, and wherein the knotting device body has one or more apertures through which an accessory cord may be passed or laced.

8. A peep sight incorporating the connector of claim 2 for attachment to a bowstring, wherein the bow cord is the bowstring, and wherein a peep sight body is mounted to the device mounting face of the connector, and wherein the peep sight body has a sight bore extending through the peep sight body, the sight bore enabling a line of sight from an archer between the two or more strands of the bowstring, and wherein the helical groove of the first stem is accommodating to receive a first strand of the bowstring, and the helical groove of the second stem is accommodating to receive a second strand of the bowstring.

9. A peep sight for mounting to a bowstring, the peep sight comprising:

a peep sight body; and a stem, wherein the bowstring comprises two or more strands, and wherein the peep sight body has a sight bore extending through the peep sight body, and wherein the sight bore enables a line of sight from an archer between the two or more strands of the bowstring, and wherein the stem is attached at a proximal end to the peep sight body, and wherein the stem includes a helical groove that is contiguous from a distal end of the stem to a distal end of the peep sight body, the helical groove being accommodating to receive at least one strand of the two or more strands of the bowstring, and wherein the distal end of the stem is connectable to the bowstring by laying the at least one strand of the bowstring into the helical groove.

10. The peep sight of claim 9, further comprising one or more additional stem, wherein each of the one or more additional stem is attached at a proximal end to the peep sight body, and wherein each of the one or more additional stem includes a helical groove, each helical groove being accommodating to receive at least a strand of the bowstring, and wherein a distal end of each of the one or more additional stem is connectable to the bowstring by laying at least a strand of the bowstring into each helical groove.

11. A connector for use in archery for attachment of a device to a bow cord, the connector comprising:

a first stem, and a connector base, wherein the connector base is contiguous with a base of the device at an end of the connector base proximal to the device, and wherein the connector base is contiguous with the first stem at the end of the connector base which is distal to the device, and wherein the first stem includes a helical groove, the helical groove being accommodating to receive the bow cord, and wherein the device includes a flute that is linear and formed to be coaxially contiguous with the helical groove to form an extended groove, and wherein the extended groove is connectable to the bow cord by laying at least a strand of the bow cord into the extended groove, and wherein the extended groove is configurable to establish friction between the bow cord and the extended groove.

* * * * *